US005511356A

United States Patent [19]

Schultz

[11] Patent Number: 5,511,356

[45] Date of Patent: Apr. 30, 1996

[54] MODULE COMPRISED OF FIBER MATS

[75] Inventor: Adolf Schultz, Glinde, Germany

[73] Assignee: Gossler Feuerfest- und Isoliertechnik GmbH, Reinbek, Germany

[21] Appl. No.: 384,439

[22] Filed: Feb. 2, 1995

Related U.S. Application Data

[63] Continuation of Ser. No. 153,478, Nov. 16, 1993, abandoned, which is a continuation of Ser. No. 828,887, filed as PCT/EP91/01076 Jun. 8, 1991, abandoned.

[30] Foreign Application Priority Data

Jun. 13, 1990 [DE] Germany ..... 9006687 U

[51] Int. Cl.[6] ..... E04B 1/00

[52] U.S. Cl. ..... 52/746.1; 52/404.1; 52/404.2

[58] Field of Search ..... 52/746, 747, 745.21, 52/745.06, 404, 506, 509, 512

[56] References Cited

U.S. PATENT DOCUMENTS

| | | | |
|---|---|---|---|
| 1,873,050 | 8/1932 | Schrader | 52/506 |
| 3,832,815 | 9/1974 | Balaz et al. | 52/509 X |
| 3,892,396 | 7/1975 | Monahgan | 52/506 X |
| 4,429,504 | 2/1984 | Hounsel et al. | 52/509 X |
| 4,494,295 | 1/1985 | Herring | 52/506 X |
| 4,605,583 | 8/1986 | Frahme | 52/509 X |
| 4,633,637 | 1/1987 | Frahme | 52/512 |
| 4,928,466 | 5/1990 | Alexander | 52/509 |
| 5,014,482 | 5/1991 | Alexander | 52/506 |

*Primary Examiner*—Jerry Redman

*Attorney, Agent, or Firm*—Robert W. Becker & Associates

[57] ABSTRACT

A module of fiber mats for insulating roofs, ceilings, walls, and floors of buildings is made of a plurality of fiber mats arranged adjacent to one another to form a rectangular body. At least one transverse rod is inserted into the adjacent fiber mats and penetrates at least partially the rectangular body. At least one fastening element cooperates with the transverse rod for connecting the module to the building, whereby a portion of the fastening element that extends into the module is in the form of a plate having a plurality of bores, distributed closely adjacent to one another in a random fashion over the surface of the plate, for receiving the transverse rod. The fastening element is in the form of an L-shaped member made from flat material, whereby a leg of the member extending parallel to the face of module is provided with a device for attaching the module to the building.

8 Claims, 1 Drawing Sheet

MODULE COMPRISED OF FIBER MATS

This application is a continuation of application Ser. No. 08/153,478 filed Nov. 16, 1993, now abandoned, which is a continuation of application Ser. No. 08/828,887 filed as PCT/EP91/01076 Jun. 8, 1991, now abandoned.

BACKGROUND OF THE INVENTION

The invention concerns a module of fiber mats for insulating walls, ceilings, etc. in which a plurality of fiber mats is supported by at least one transverse rod extending parallel to the wall in the form of a rectangular body and in which each transverse rod is gripped by at least one fastening element that is attachable to the wall.

In a cladding of the aforementioned kind known from DE-PS 2 231 658 hairpin-type elements serve to mount the modules to the wall, whereby the hairpin-type elements are inserted between the parting seams of the fiber mats, are guided about the transverse rods and are subsequently clamped into respective means at the wall. This kind of fastening the modules to the wall is very laborious since the hairpin-type elements not only must be inserted into the parting seam between two fiber mats, which is aligned with the fastening means at the wall, but also must be guided about the transverse rods and must be clamped at the attaching means.

It is therefore an object of the invention to facilitate the mounting of a module composed of fiber mats for sound and/or heat insulation of walls, ceilings etc.

SUMMARY OF THE INVENTION

Based on the module of the aforementioned kind, this object is inventively solved by providing the sections of the fastening elements which extend into the module in the form of a plate having a plurality of bores, distributed closely adjacent to one another in a random fashion, for receiving the transverse rods.

The mounting of the modules provided with the inventive fastening elements is very simple. After arranging the fastening elements at the wall, ceiling etc., which may be facilitated by providing them in the form of a L-shaped member formed of flat material with a leg of the member extending parallel to the face of the module being connected to a respective means at the wall, the module must only be pressed against the leg of the fastening element, which extends away from the wall parallel to the fiber mats and is provided with the bores, to thereby arrange the fastening elements between the fiber mats of the module. Subsequently, the transverse rods are inserted from the sides into the module, (which, before and during the mounting, is pressed together in a manner known per se, for example, by bands and cardboard) and thereby are inserted into a bore of the fastening element. This is easily possible not only due to the plurality of bores distributed in a sieve-type arrangement at the fastening element but also, in a preferred embodiment of the invention, due to the pointed tip of the transverse rod to be inserted into the module. After a wall has been completely covered with such modules to form an insulation system, the elements which hold the modules together are removed so that the prestressed modules expand and the slots between the individual modules resulting from the mounting will be closed.

BRIEF DESCRIPTION OF THE DRAWINGS

An embodiment of the invention will now be described with the aid of the drawings, in which.

DESCRIPTION OF PREFERRED EMBODIMENTS

Figure 1:
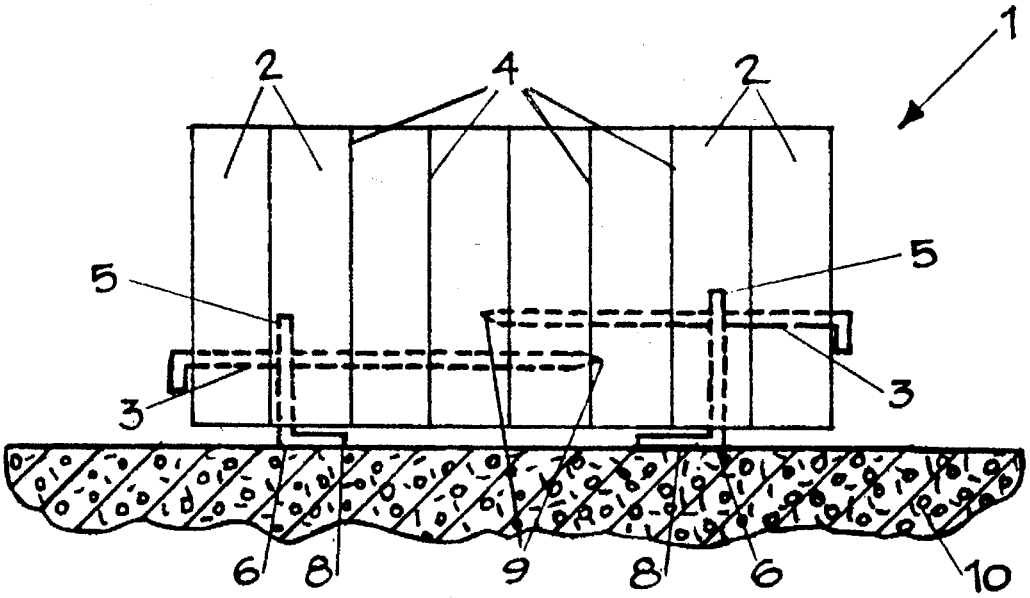
FIG. 1 is a schematic view of the module of an insulating cladding of wall.
Figure 2:
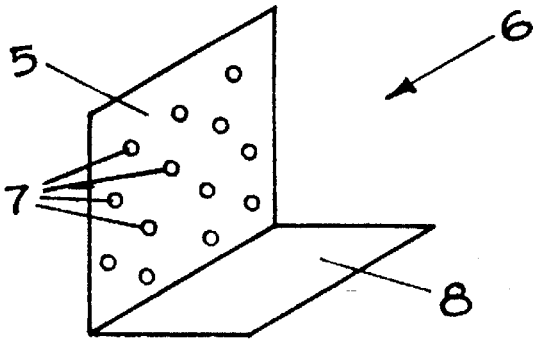
FIG. 2 is a schematic perspective view of a fastening element for the module of FIG. 1.

The represented module 1 is comprised of a plurality of fiber mats 2 arranged adjacent to one another which are held together in the form of a rectangular block by transverse rods 3. Parallel to the seam 4 of the individual fiber mats 2 the leg 5 of the L-shaped fastening element 6 is inserted into the fiber mats 2 or seams 4. The fastening elements 6 may be manufactured by bending sheet metal strips. The leg 5 inserted between the fiber mats 2 is provided with a plurality of bores 7. A transverse rod 3 extends through one of these bores 7 whereby the transverse rod 3 has been inserted into the module 1 from the side to support the fastening element 6 within the module 1. The tip 9 of the end of the transverse rod 3 extending into the module 1 is pointed and thereby facilitates the insertion into the module 1. This tip 9 al so serves as a guiding element for the insertion of the transverse rod 3 into the bore 7 of the leg 5.

The other leg 8 of the fastening element 6 rests at the face of the module 1 and is provided with means (not shown) for attaching it and thus the module 1 to the wall 10 of the building.

The present invention is, of course, in no way restricted to the specific disclosure of the specification and drawings, but also encompasses any modifications within the scope of the appended claims. The present invention is, of course, in no way restricted to the specific disclosure of the specification and drawings, but also encompasses any modifications within the scope of the appended claims.

I claim:

1. A method of producing an insulation system comprised of a plurality of modules, each module comprised of a plurality of fiber mats, at least one fastening element and at least one transverse rod, for insulating surfaces selected from the group of roofs, walls, ceilings, and floors, said method comprising the steps of:

a) arranging a plurality of fiber mats adjacent to one another to form a rectangular body;

b) providing at least one fastening element comprising a perforated plate with a plurality of bores distributed randomly and closely adjacent to one another over a surface of said plate;

c) connecting said at least one fastening element to a surface to be insulated;

d) positioning said rectangular body on said at least one fastening element such that said perforated plate extends into said rectangular body parallel to said adjacent fiber mats;

e) pushing at least one transverse rod into said rectangular body so as to extend transverse to said adjacent fiber mats and parallel to the surface to be insulated;

f) securing said at least one transverse rod at said at least one fastening element by pushing said at least one transverse rod into one of said bores to thereby connect said rectangular body to the surface to be insulated; and g) repeating steps a) to f).

2. A method according to claim 1, wherein said step of providing includes making said at least one fastening element in the form of an L-shaped member from flat material and furnishing a leg of said L-shaped member with means for connecting said L-shaped member to the surface to be insulated.

3. A method according to claim 2, wherein the other leg is said plate with a plurality of bores.

4. A method according to claim 1, wherein a forward end of said at least one transverse rod pushed into said body has a pointed tip.

5. A method according to claim 1, wherein said step of pushing includes inserting a first and a second one of said transverse rods into said rectangular body.

6. A method according to claim 5, wherein said step of pushing includes inserting said first and said second transverse rods into said rectangular body from opposite end faces of said rectangular body.

7. A method according to claim 5, wherein only one of said fastening elements is provided and said first and said second transverse rods cooperate with said one fastening element.

8. A method according to claim 5, wherein said step of providing includes providing a first and a second one of said fastening elements, wherein said first transverse rod cooperates with said first fastening element and said second transverse rod cooperates with said second fastening element.

* * * * *